US006253519B1

(12) United States Patent
Daniel

(10) Patent No.: US 6,253,519 B1
(45) Date of Patent: Jul. 3, 2001

(54) CONSTRUCTION BLOCK

(76) Inventor: Aaron E. Daniel, 565 S. Woorkland La., #202, Boise, ID (US) 83709

( * ) Notice: Subject to any disclaimer, the term of this patent is extended or adjusted under 35 U.S.C. 154(b) by 0 days.

(21) Appl. No.: 09/414,860

(22) Filed: Oct. 12, 1999

(51) Int. Cl.[7] ..... E04B 2/08; E04B 2/18
(52) U.S. Cl. ..... 52/591.1; 52/604; 52/607
(58) Field of Search ..... 52/591.1, 604, 52/605, 606, 607

(56) References Cited

U.S. PATENT DOCUMENTS

| | | | | |
|---|---|---|---|---|
| 3,269,070 | * | 8/1966 | Stoy | 52/591.1 X |
| 3,422,588 | * | 1/1969 | Stewart, Jr. | 52/605 X |
| 4,018,018 | * | 4/1977 | Kosuge | 52/607 X |
| 4,319,440 | * | 3/1982 | Rassias et al. | 52/605 X |
| 4,367,615 | * | 1/1983 | Feldman | 52/591.1 |
| 4,372,091 | * | 2/1983 | Brown et al. | 52/604 X |
| 4,514,949 | * | 5/1985 | Crespo | 52/607 X |
| 4,698,949 | * | 10/1987 | Dietrich | 52/604 X |
| 5,379,565 | * | 1/1995 | Vienne | 52/606 |
| 5,402,609 | * | 4/1995 | Kelley, Jr. | 52/604 |
| 5,457,926 | * | 10/1995 | Jensen | 52/604 |
| 5,802,797 | * | 9/1998 | Stoer-folt | 52/604 |
| 5,894,702 | * | 4/1999 | Stenekes | 52/604 X |
| 5,899,040 | * | 5/1999 | Cerrato | 52/604 |
| 5,960,604 | * | 10/1999 | Blanton | 52/591.1 X |
| 6,065,265 | * | 5/2000 | Stenekes | 52/607 |
| 6,082,067 | * | 7/2000 | Bott | 52/604 X |

FOREIGN PATENT DOCUMENTS

| | | | | |
|---|---|---|---|---|
| 256279 | * | 5/1963 | (AU) | 52/591.1 |
| 62945 | * | 11/1944 | (DK) | 52/591.1 |
| 537857 | * | 5/1922 | (FR) | 52/591.1 |
| 913306 | * | 9/1946 | (FR) | 52/591.1 |

* cited by examiner

*Primary Examiner*—Peter M. Cuomo
*Assistant Examiner*—Rodney B. White
(74) *Attorney, Agent, or Firm*—Stephen M. Nipper; Frank J. Dykas; Robert L. Shaver

(57) ABSTRACT

Right rectangular parallelepiped construction modules including a system of latitudinal tangs and grooves and inner and outer shoulders which cooperate to interlock stacked or staggered construction modules. The construction modules can also include reliefs in their tops, sides and bottoms for receiving rebar supports, electrical lines, plumbing lines, or other means.

19 Claims, 14 Drawing Sheets

CONSTRUCTION BLOCK

BACKGROUND OF THE INVENTION

1. Field of the Invention

The present invention generally relates to construction, and more particularly to construction modules for the building of walls and other structures.

2. Background Information

Using building blocks or construction modules to construct structures is an old art dating back to the time before the building of the Great Pyramids. In modern times, the use of such modules is frequently used to construct both buildings and walls, among other types of other structures. One common type of construction module is referred to in the trade as a "cinder block." These cinder blocks are typically rectangular in shape, having hollow centers. These blocks are typically stacked upward, in a staggered effect and bonded together through the use of mortar. Examples of such a building method can be seen in U.S. Pat. No. 4,726,567 (Greenberg), showing a masonry fence system.

Another example of such a construction module is shown in U.S. Pat. No. 4,341,050 (Long). The Long module is a self-aligning and interlocking module.

Also shown in the prior art is U.S. Pat. No. 3,936,987 (Calvin) showing interlocking brick or building block and walls constructed therefrom. The Calvin blocks have flat top and bottom faces which abut adjoining top and bottom faces.

Problems with the prior art blocks include the requirement for the use of mortar to properly place the blocks. It is this mortar that holds the blocks together. Such type of attachment to one another is time consuming and does not result in the strength requirements for certain applications.

Another disadvantage of the old methods is the failure to include integral channels and reliefs allowing for electrical and plumbing lines to be run closely and flushly against the wall. The present invention solves these problems.

Additional, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

The present invention is a construction module in the general form of a right rectangular parallelepiped having a pair of side faces, a pair of end faces, a top face and a bottom face. The top face has latitudinal grooves and the bottom face has latitudinal tangs. These tangs and grooves are able to cooperate when the modules are either stacked or staggered, thereby interlocking the modules together. The tops and bottoms also have inner and outer shoulders which further cooperate to hold the stacked or staggered construction modules together.

Attachment together can be further helped through use of a bonding means applied between adjacent blocks. It is preferred that the blocks will further comprise channels for holding quantities of bonding means, thereby assisting in such attachment.

Vertical channels exist through the centers of the blocks and half vertical channels exist on the ends. In such an arrangement, when two blocks are butted next to one another, the two half channels ends form a single channel which aligns with other stacked ends, or with center channels of other blocks stacked in a staggered fashion there above. These joints and channels are able to receive attachment means such as rebar or bonding means such as concrete, or other items. It is also envisioned that through the various faces of the modules will be channels for receiving junction boxes, electrical lines, plumbing lines, and other devices.

Blocks can be held together through attachment means. The inside channels or channeled blocks may further comprise ledges for assisting in the attachment means and attaching stacked and staggered blocks together.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects, all without departing from the invention. Accordingly, the drawings and description of the preferred embodiment are to be regarded as illustrative in nature, and not as restrictive.

DESCRIPTION OF THE PREFERRED EMBODIMENTS

Figure 1:
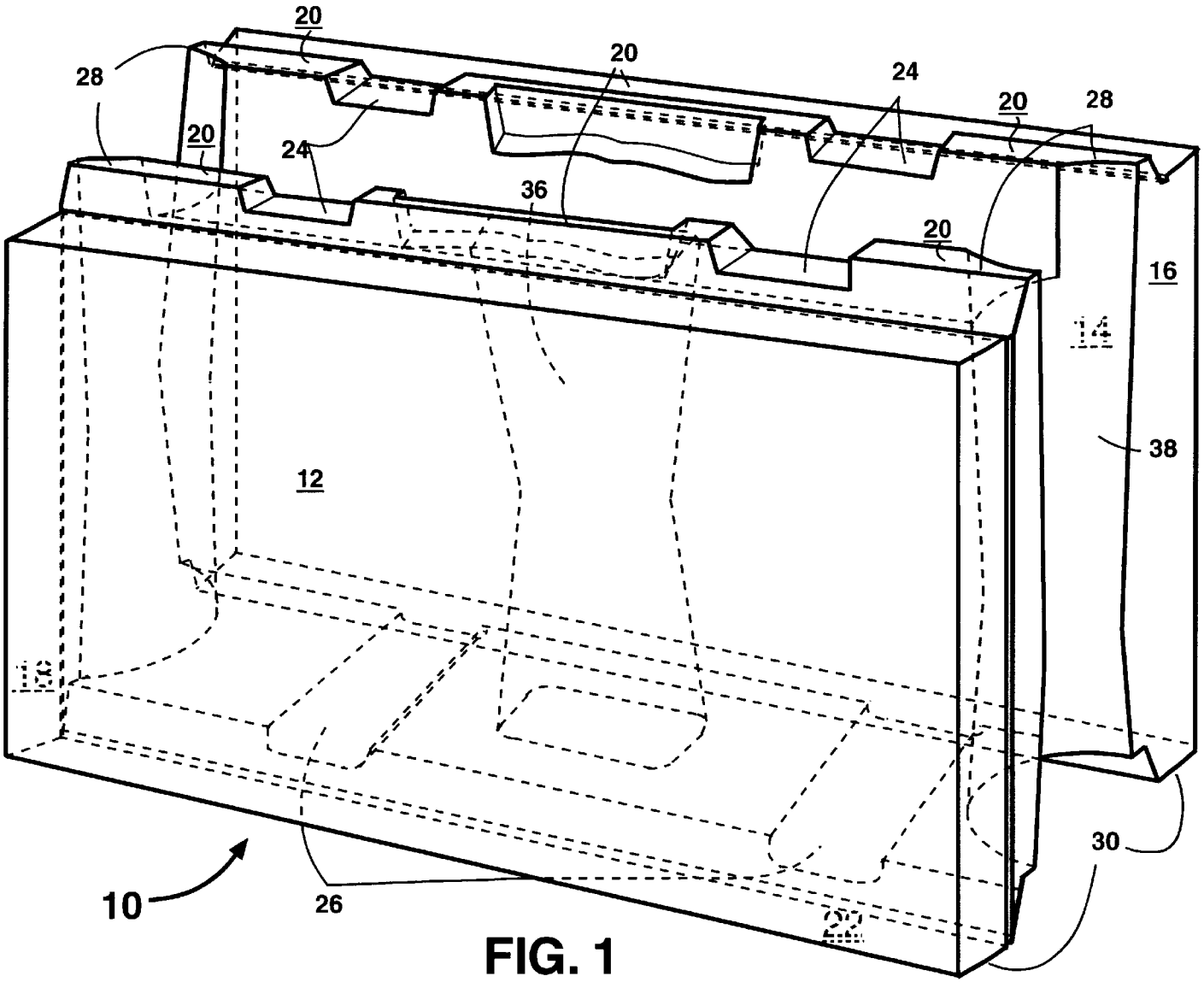
FIG. 1 is a perspective view of one embodiment of the present invention.
Figure 2:
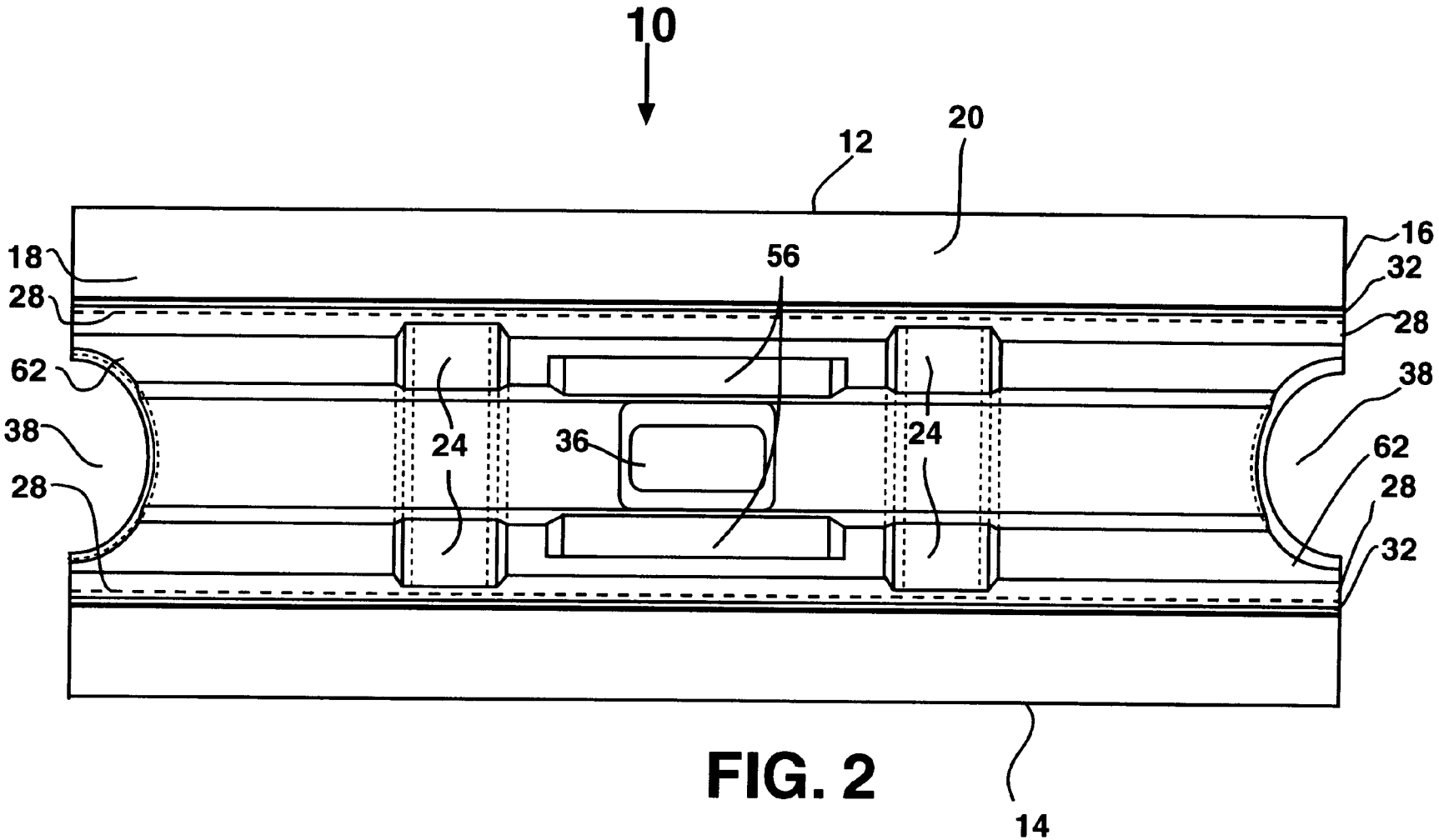
FIG. 2 is a top view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

As shown in FIG. 1, the present invention is a construction module 10 for building walls and other structures. The invented module 10 is in the general form of a generally right rectangular parallelepiped having a first side face 12, a second side face 14, a first end face 16, and second end face 18, a top face 20, and a bottom face 22.

Figure 6A:
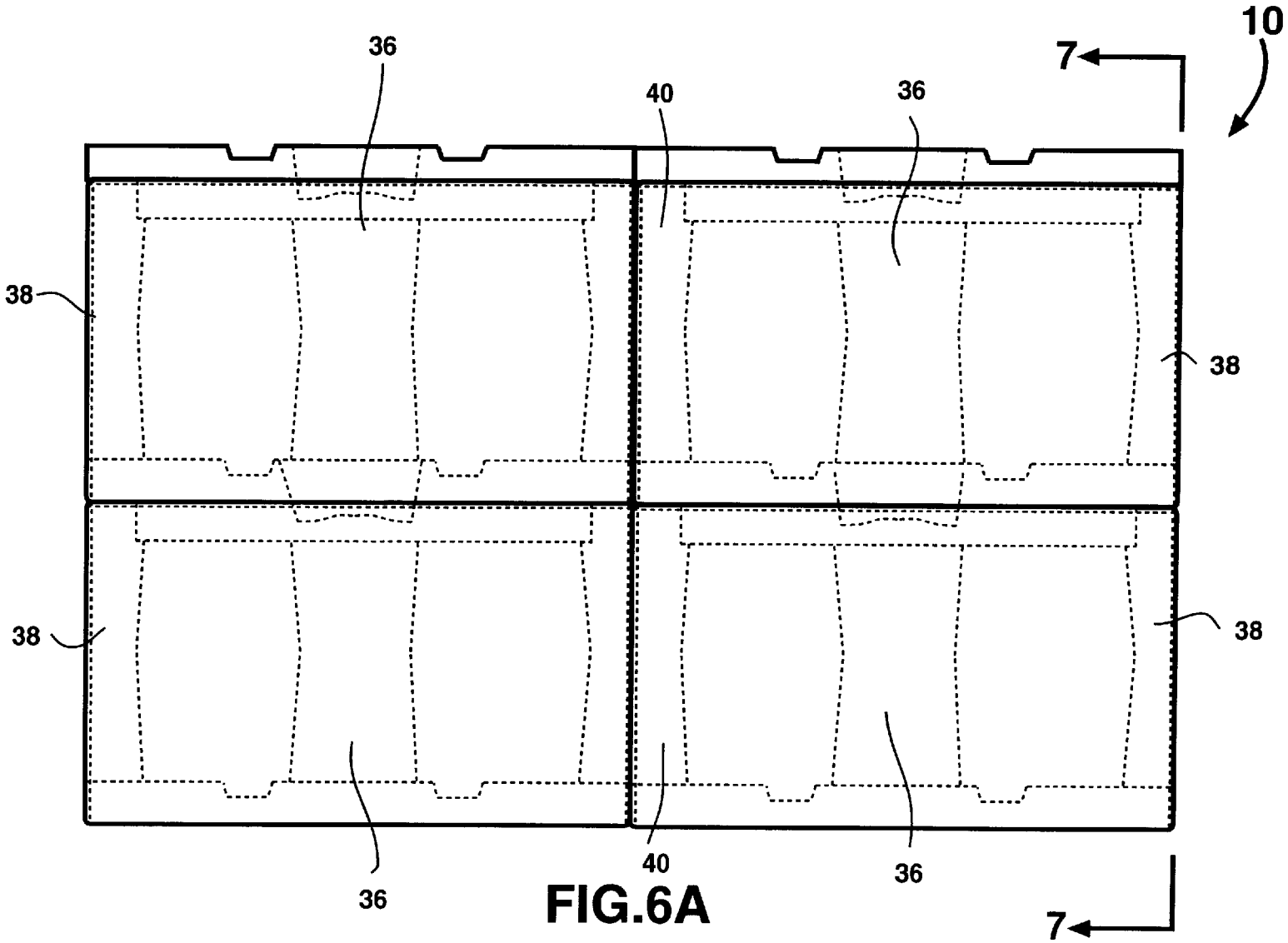
FIG. 6A is a side view showing four stacked modules of one embodiment of the present invention.
Figure 6B:
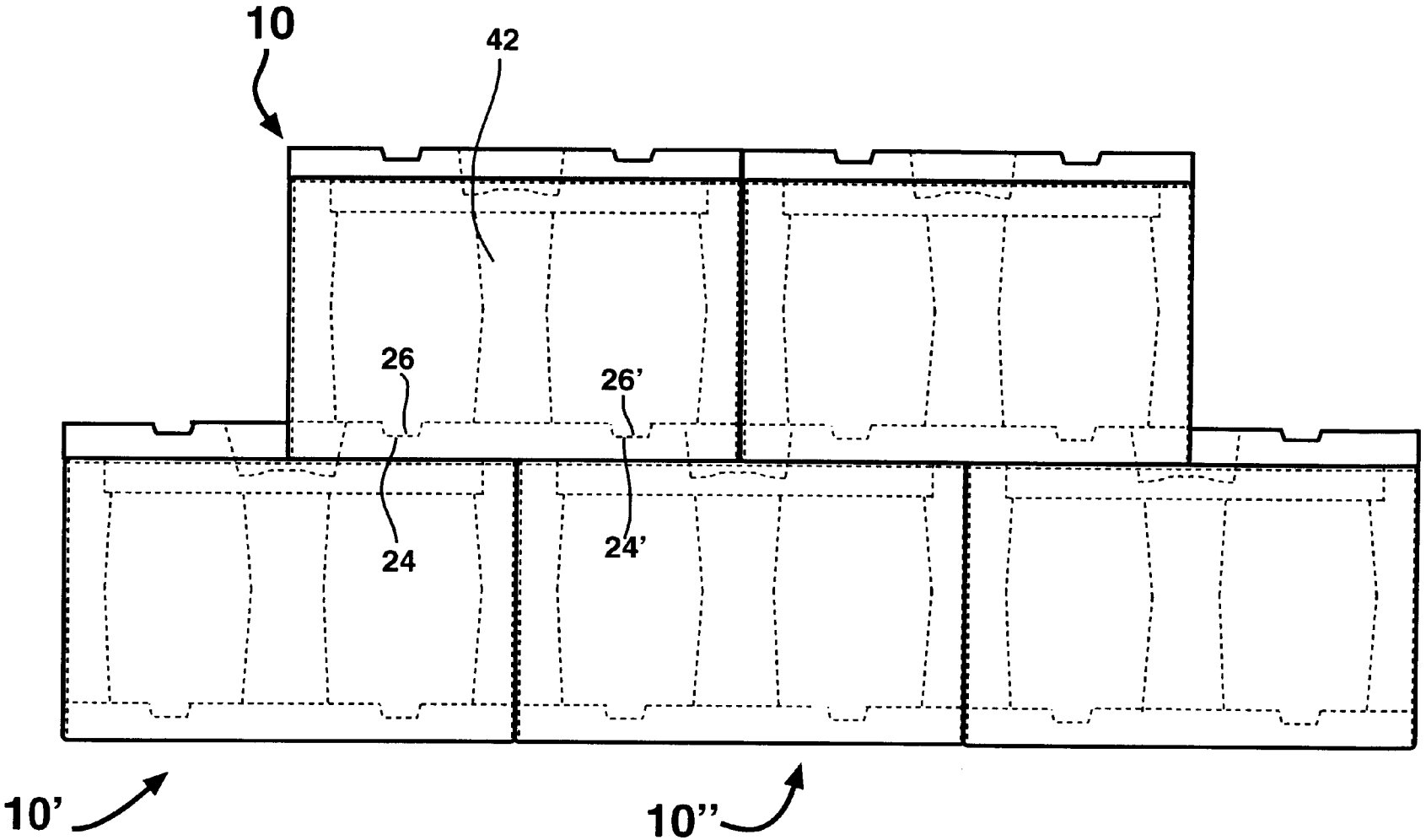
FIG. 6B shows three modules of one embodiment of the present invention in a staggered arrangement.
Figure 7:
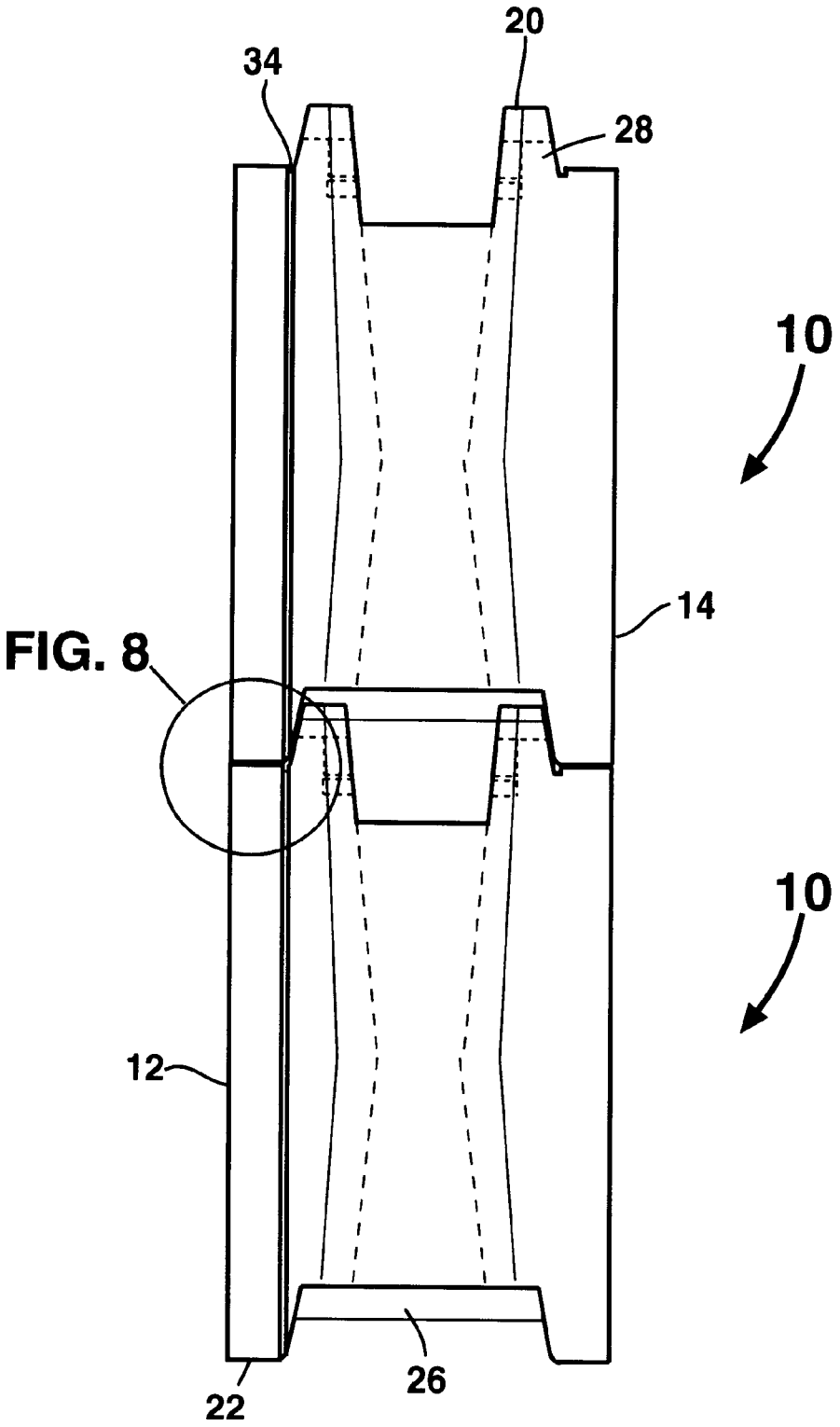
FIG. 7 is a side view of the modules shown in the FIG. 6A along line 7—7.

The top faces 20 of the module 10 includes at least one latitudinal groove 24 extending perpendicular to the side faces 12, 14 across the top face 20 and parallel to the end faces 16, 18. The bottom face 22 of the module 10 includes at least one matching latitudinal tang 26 extending perpendicular to the side faces 12, 14 across the bottom face 22 and parallel to the end faces 16, 18. The tang 26 of a first module 10 is able to be received into the groove 24 of a second module 10', as shown in FIGS. 6 & 7, thereby interfittingly locking plural modules together.

The preferred embodiment has two tangs 26 and two grooves 24 located so that adjacent modules 10, 10' can either be stacked vertically, one on top of one another, or stacked in a staggered portion so that in a module having two tangs 26, 26', a first tang 26 would be received into a groove 24 of a first module 10', and the second tang 26' would be able to be received into the groove 24' of a second module 10". Such stacking is shown in FIG. 6.

Figure 8:
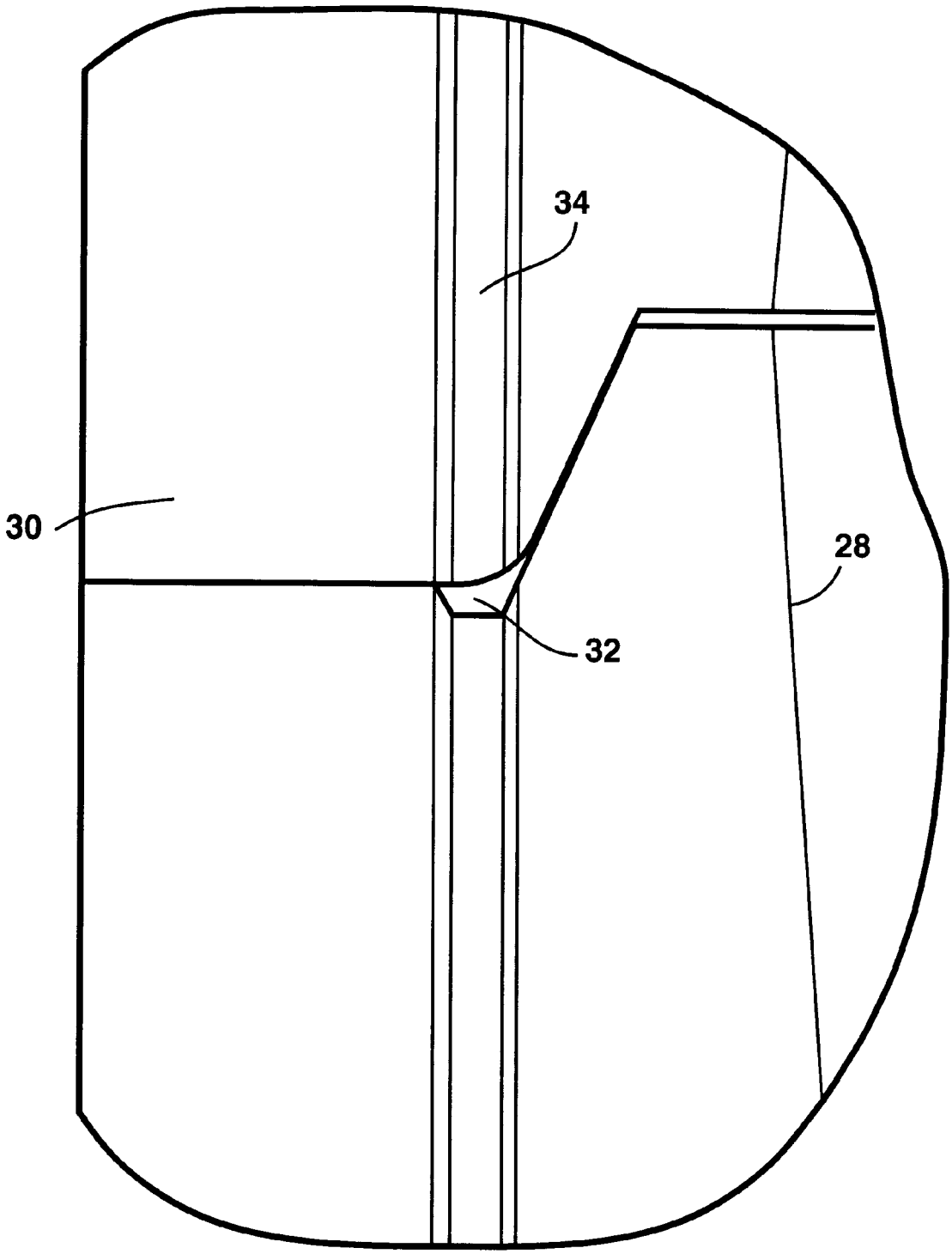
FIG. 8 is a partial view as view as noted in FIG. 7.

The top face 20 further comprises at least one longitudinal inner shoulder 28 extending slightly inwards from one of the side faces. The bottom face 22 further comprises at least one longitudinal outer shoulder 30, said outer shoulder 30 preferably extending from the side face inward. The inner shoulder 28 receives and interfits with outer shoulder 30 of an adjacent module. Thereby interfittingly locking plural modules together, as shown in FIGS. 7 & 8.

It is preferred that the top face 20 comprise two longitudinal inner shoulders 28 and the bottom face 22 comprises a complement of two longitudinal outer shoulders 30. When plural modules are so stacked, the tangs 26 and grooves 24 and shoulders 28, 30 cooperate to inhibit all sliding movement of the modules, either latitudinally or longitudinally.

Such interfitting attachments can be further secured through the use of a bonding means applied to the joints between the grooves and tangs and between the inner shoulders and outer shoulders. Additionally, a relief 32 may exist in the inner or outer shoulder and within the ends themselves (relief 34) thereby allowing a quantity of bonding means to be applied to the surface thereby increasing the strength of the bonds. Suitable bonding means can be any appropriate material from sealants to adhesives, to mortar, so long as the bonding means is appropriate for holding plural modules together. It is preferred that said bonding means will have elastic properties thereby allowing the structure built to withstand some movement and changes due to environmental conditions. Such a bonding material would also preferably allow for lateral thermal expansion and contraction and provide highly survivable flexibility under natural and extraordinary stresses. Transfer of load carried by such structure is done by space-to-space contact of accurately cast surfaces, and distribution by the elastic nature of the bonding means. Such a wall would also have features of being water resistant.

The construction module 10 also preferably comprises a center channel 36 vertically through the center of the module 10 extending from top face 20 to bottom face 22. Stacked modules will have aligned center channels 36. This center channel can be used for many purposes, including the insertion of attachment means for attaching modules together or modules to a footer or other means; for inclusion of an insulating material; for receipt of a bonding means, such as concrete; or for other purposes.

Figure 3:
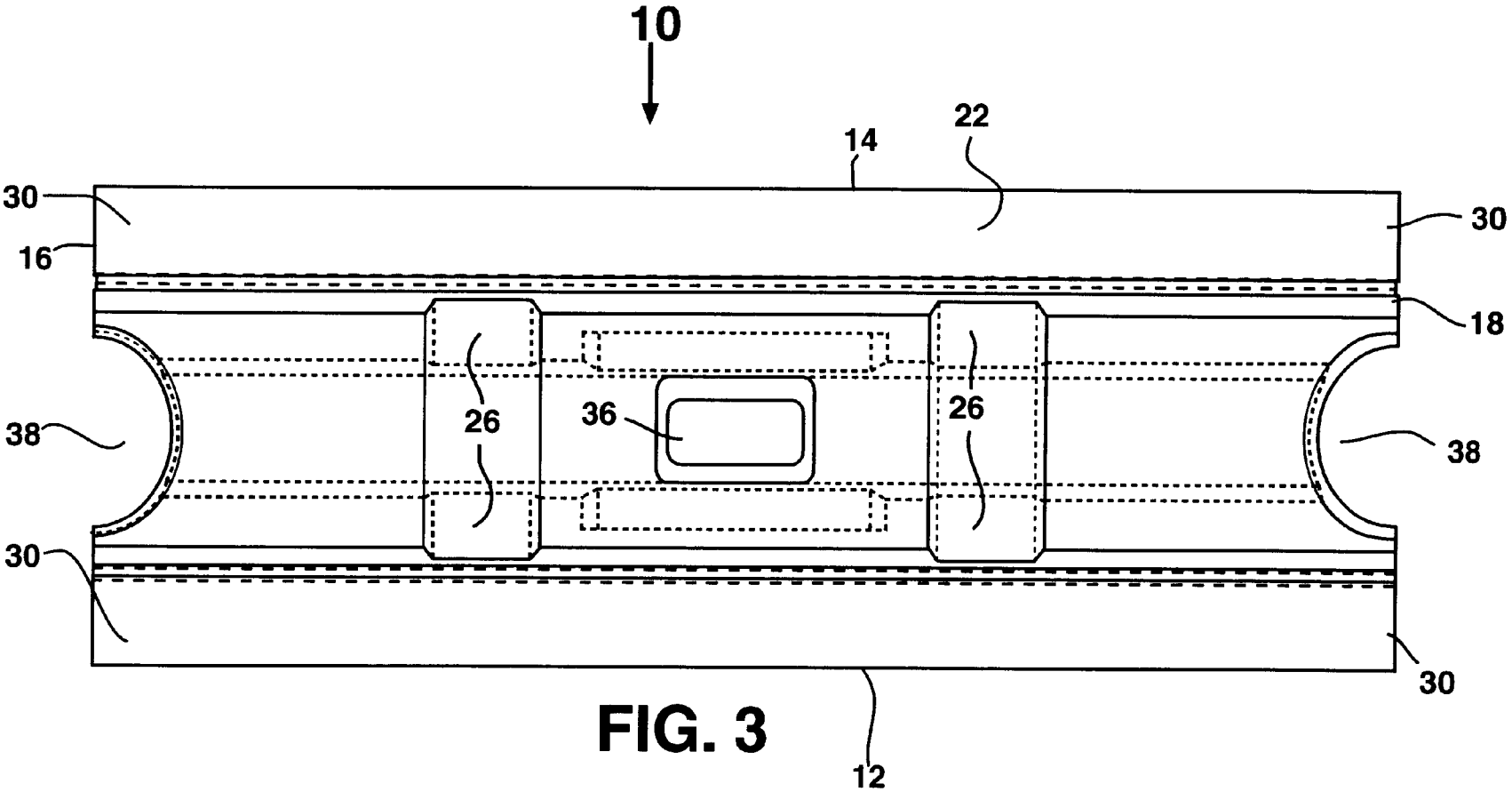
FIG. 3 is a bottom view of one embodiment of the present invention.
Figure 4:
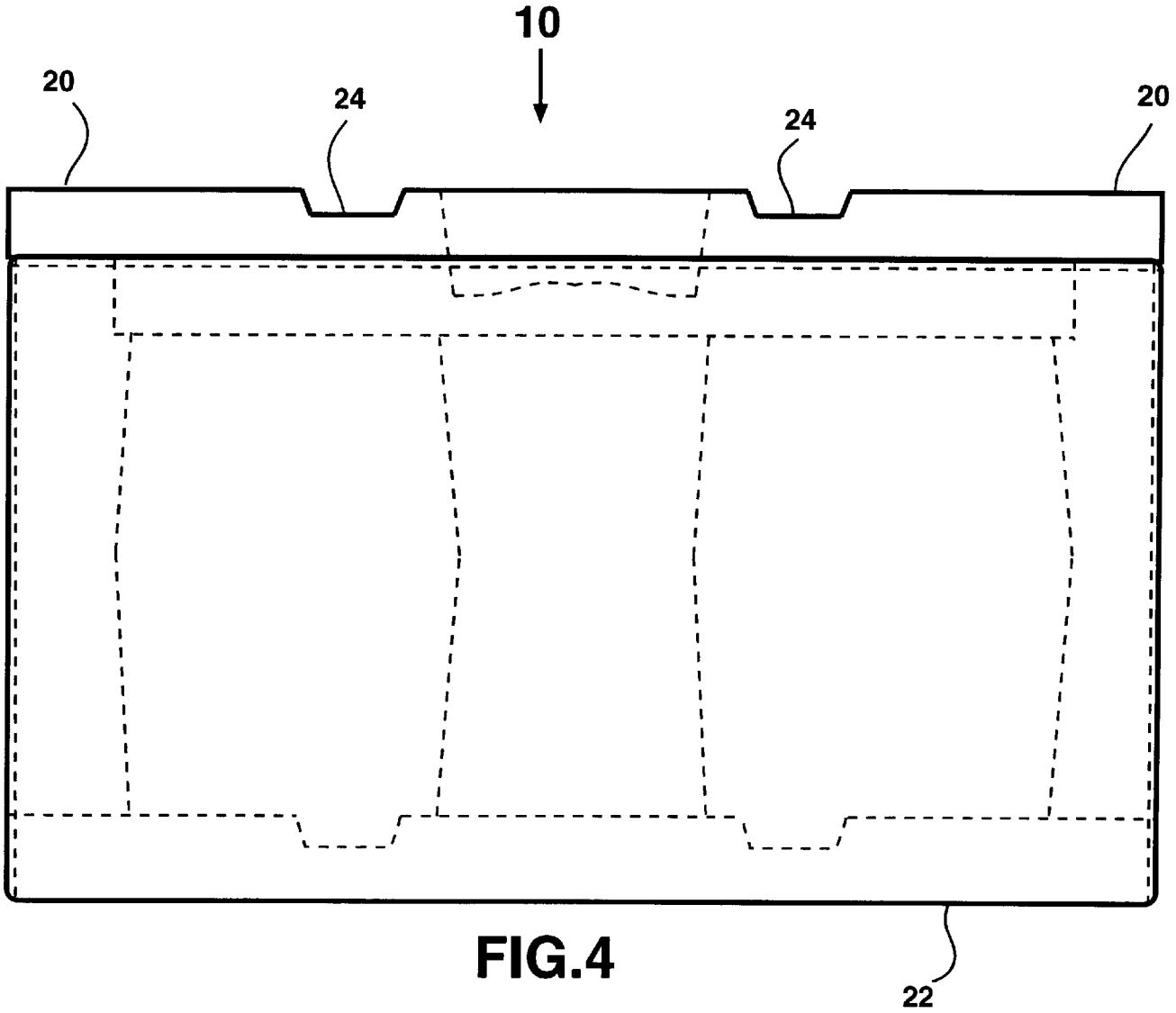
FIG. 4 is a side view of one embodiment of the present invention.
Figure 5:
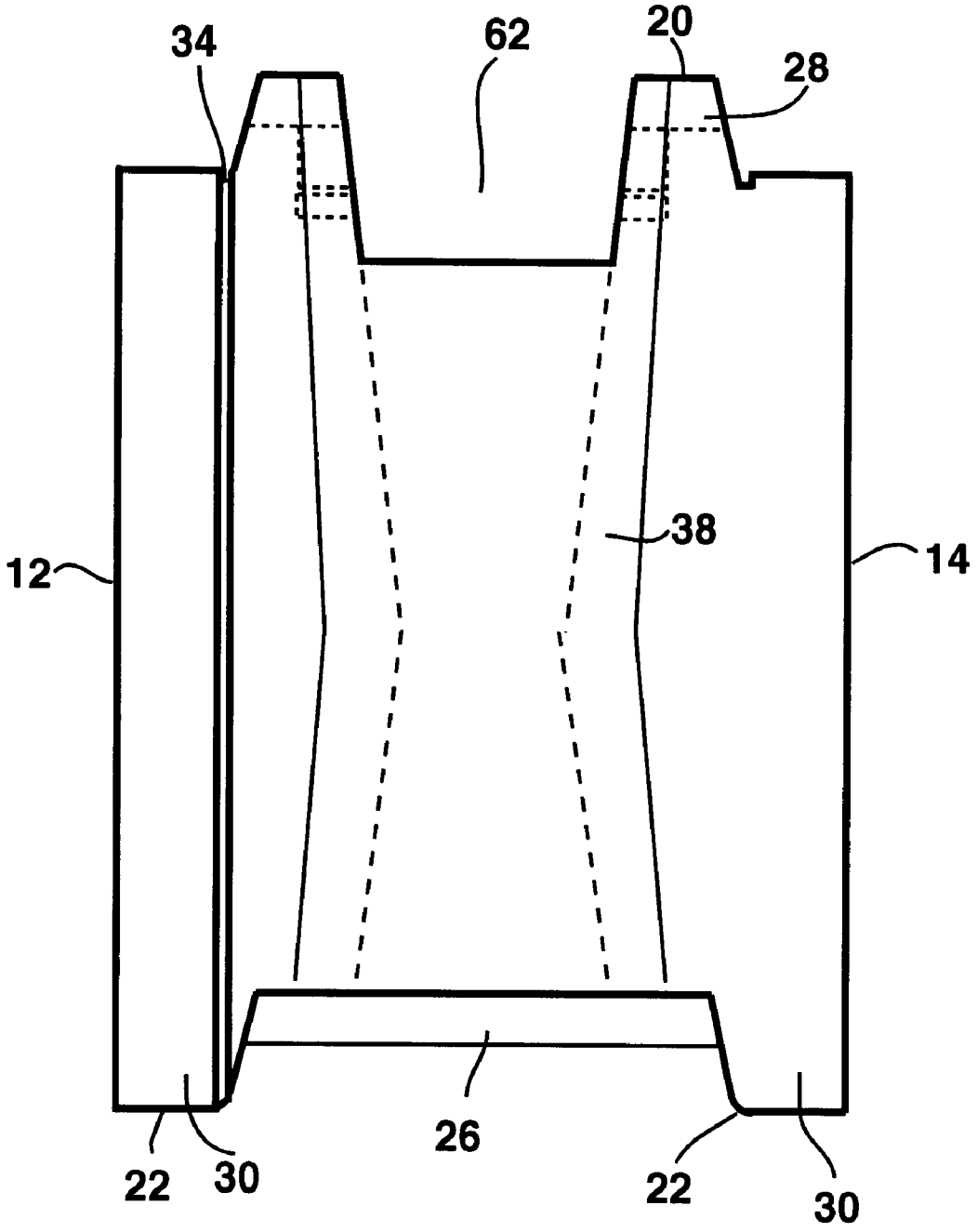
FIG. 5 is an end view of one embodiment of the present invention.

As shown in FIGS. 3 and 5, each of the end faces 16, 18, preferably also comprise vertical troughs 38 extending within the end face 16, 18 from the bottom face 22 to the top face 20. The troughs 38 of adjacent module ends jointly form end channels 40 extending vertically, as shown in FIG. 6A.

When adjacent modules are stacked in a staggered position, the end channels 40 alternatingly align with the center channels 36 to form joint channels 42 extending vertically through the pieces. An example of this is shown in FIG. 6B.

The side faces 12, 14 may further comprise horizontal conduits 44 or vertical conduits 48 extending to said side face. These conduits can be for receiving wiring, plumbing or other materials. Also envisioned is the receipt of an insert, into the conduit. This insert would allow a material such as drywall to be affixed to the stacked modules by a screw extending, for instance, through the drywall and into the insert. These inserts will be rigidly affixed into said conduits, either through dovetailing, friction or through an adhesive or other bonding means. The conduits 44, 48 and inserts may be made of a dovetailed type of shape so that the inserts slide into the conduits.

Figure 9:
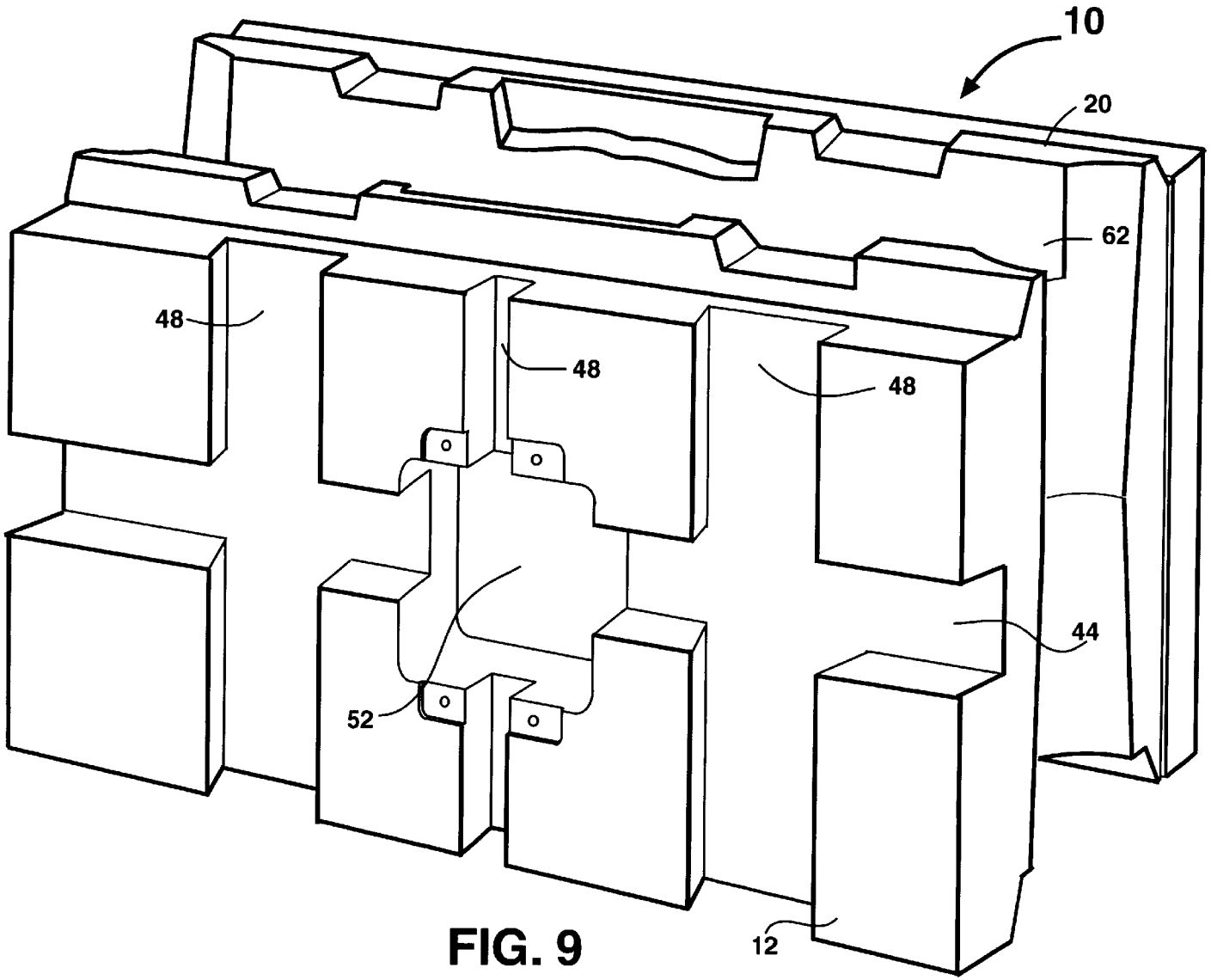
FIG. 9 is a perspective side view of another embodiment of the present invention.

Still referring to FIG. 9, a conduit cavity 52 may be found along any of the conduits 44, 48, this cavity 52 extending into the module 10. Such a cavity 52 would allow receipt of a joint box, for instance. This cavity may extend through the module 10 and into one of the center 36, end 40, or joint 42 channels. Such an arrangement allows for wiring and plumbing to be properly and easily extended along the faces of the modules without requiring said wiring, plumbing or other apparatuses to project outwards from the surface of the modules. Also envisioned is a sluice or horizontal relief 62 running though the top 20 of the module 10, thereby allowing apparatuses such as plumbing or wiring to be laid along the top surfaces of the modules.

Figure 11:
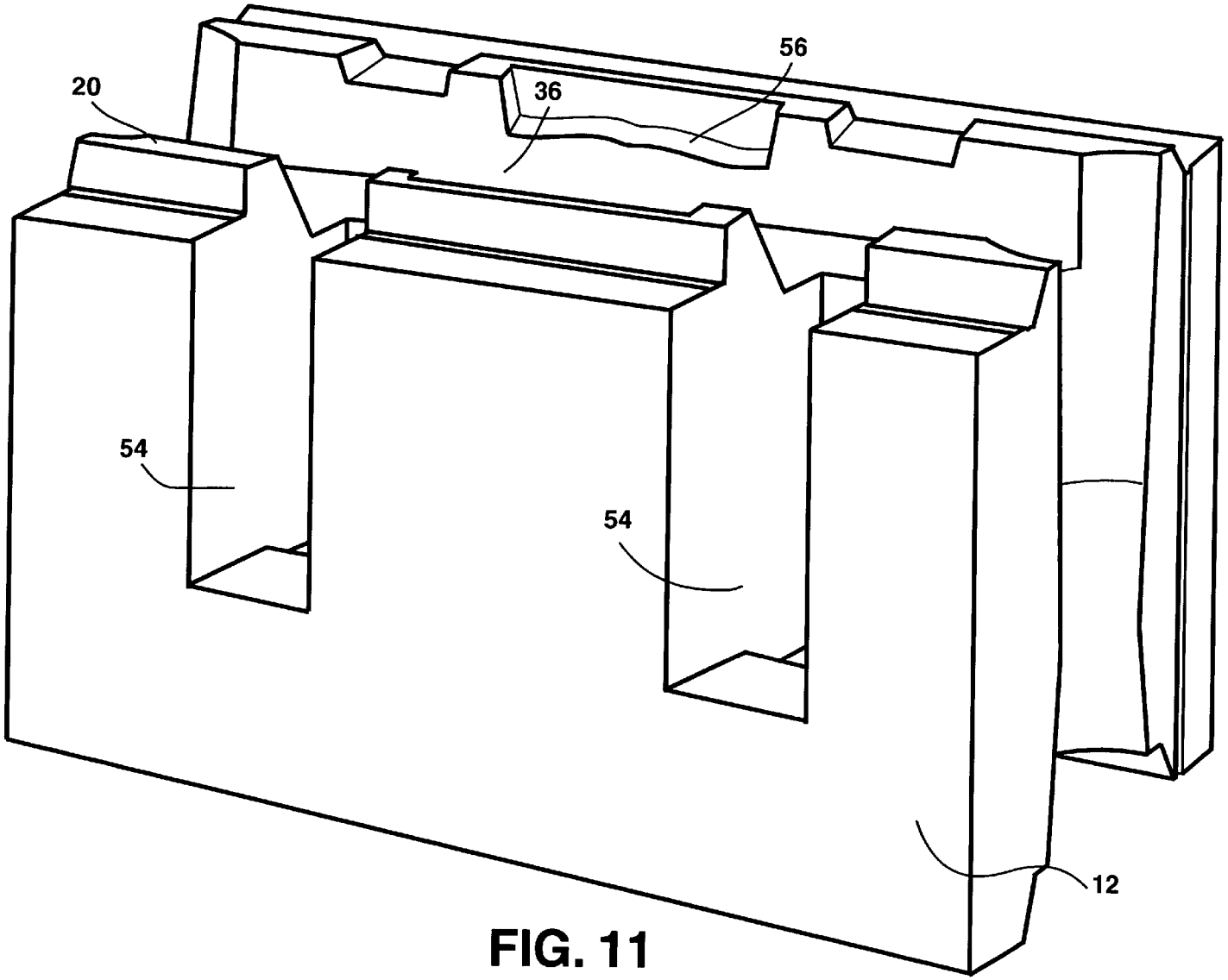
FIG. 11 is a perspective view of another embodiment of the present invention.

Also envisioned, as shown in FIG. 11, is the inclusion of joist relief notches 54 extending generally downward from the intersection of the top face 20 and either of the sides. These joist relief notches 54 are for the receipt of standard construction joist members (not shown). Such means would allow the joist members to be attached to a foundation without necessitating the need of some kind of additional joist hanger.

Figure 12:
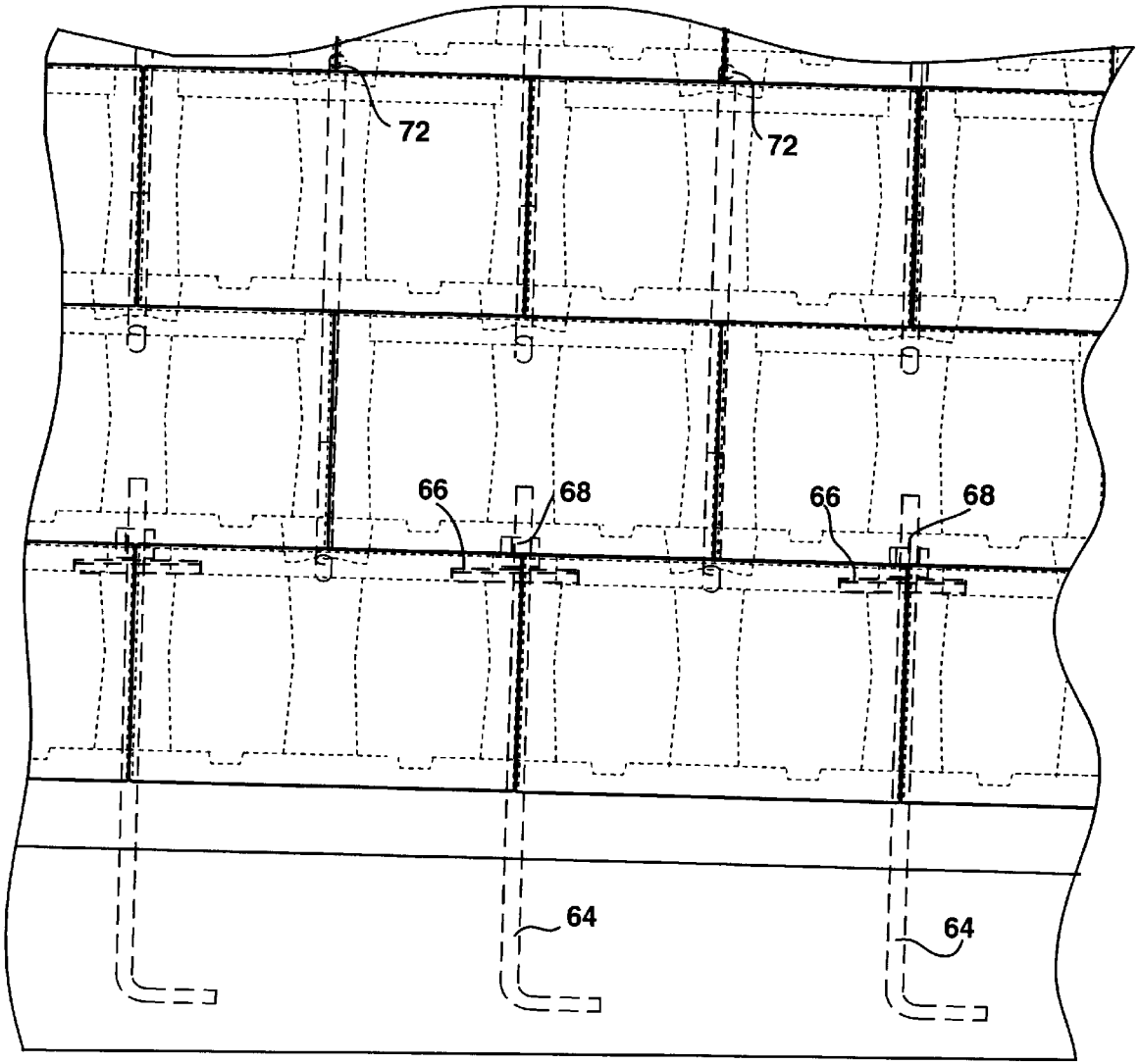
FIG. 12 is an environmental view of a plurality of modules of one embodiment of the present invention.
Figure 13A:
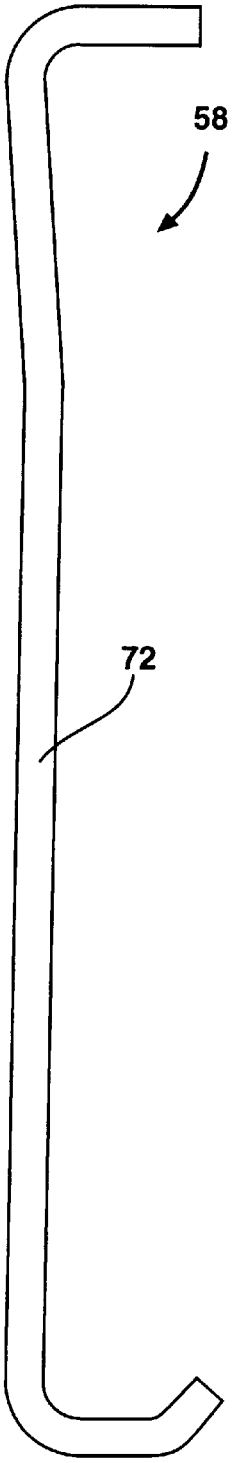
FIG. 13A is side view of a re-bar clamp.
Figure 13B:
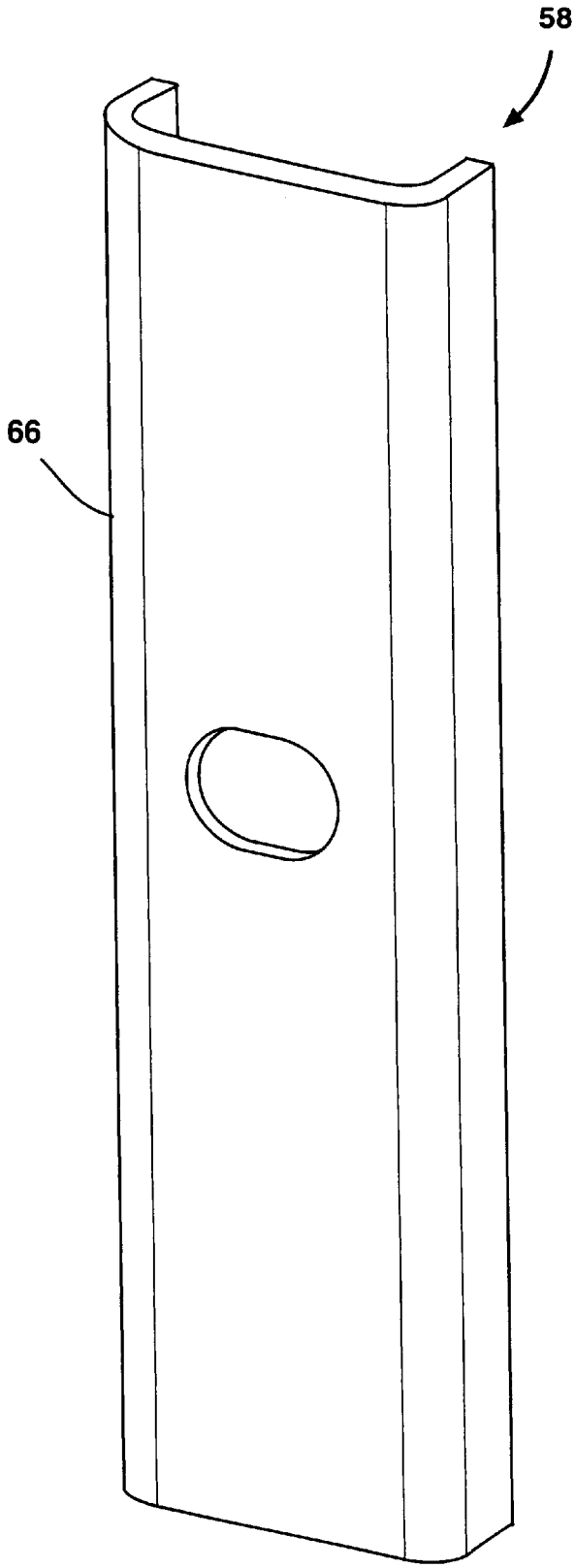
FIG. 13B is a perspective view of an anchor spanner.

As shown in FIG. 11, the center channel 36 further comprises an attachment ledge 56 at the top of the center channel 36 for cooperation with an attachment means 58. Examples of such attachment means 58, as shown in FIGS. 12, 13A, 13B, would include reinforced bar or rebar, and the combination of anchor spanners, anchor nuts and anchor bolts. Such attachment means 58 could be used to rigidly affix modules together.

For instance, an anchor bolt 64 could be formed into concrete footer 70, extending vertically therefrom. The modules could be arranged so that this anchor bolt extends upward through the center channel 36. An anchor spanner 66 would then be inserted over the top of this anchor bolt 64, said anchor bolt 64 extending through said anchor spanner 66.

An anchor nut 68 could be attached to the anchor bolt 64 and tightened down, holding the anchor spanner 66 against the attachment ledge 56 at the top of the center channel, thereby fixedly holding the construction module 10 against the footer 70. This process could be repeated for all such modules attached to the concrete footer. Modules stacked or staggered above said first row of modules could be affixed to one another through use of rebar clamp 72 as shown in FIG. 13A, or other means. Such attachment could be by extending the rebar clamp 72 through one of the joint channels 42 and attaching it. The anchor bolts are preferably threaded. The reinforcing bars are preferably one-half inch round. The anchor spanners are preferably twelve gauge steel.

The invented modules can be cast or formed of a variety of materials, for instance, concrete or concrete aggregates such as sand, gravel, Styrofoam beads, inert wastes, etc.; composite materials such as silicates, carbonates or other inert particles with binders; mixtures of natural organic/mineral compounds and fixed with heat and/or chemical processing; mixtures of wastes rendered inert by processes, encapsulating or fixing with heat and/or chemical processing or binders; or, steel, composite or other types of reinforcement cast into blocks.

Figure 10A:
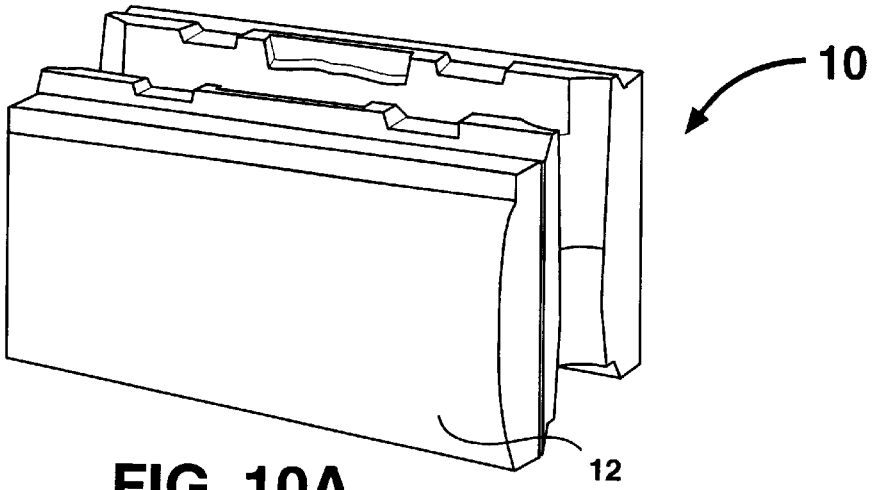
FIG. 10A is a perspective view of another embodiment of the present invention.
Figure 10B:
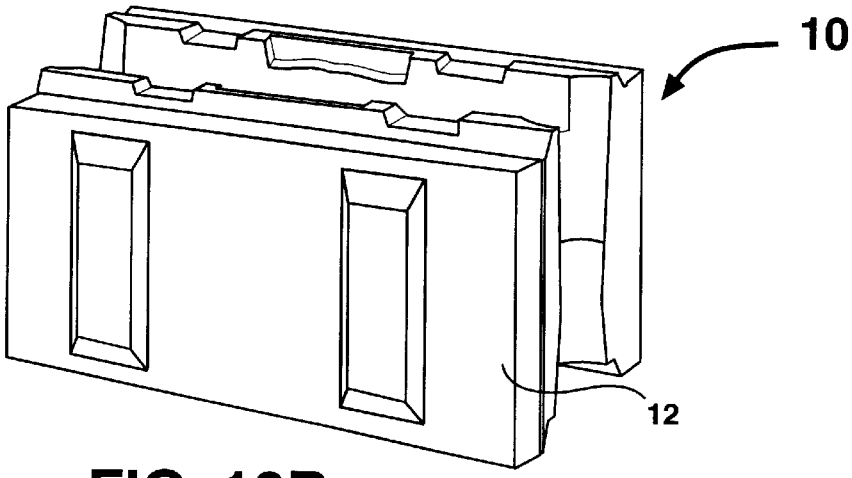
FIG. 10B is a perspective view of another embodiment of the present invention.
Figure 10C:
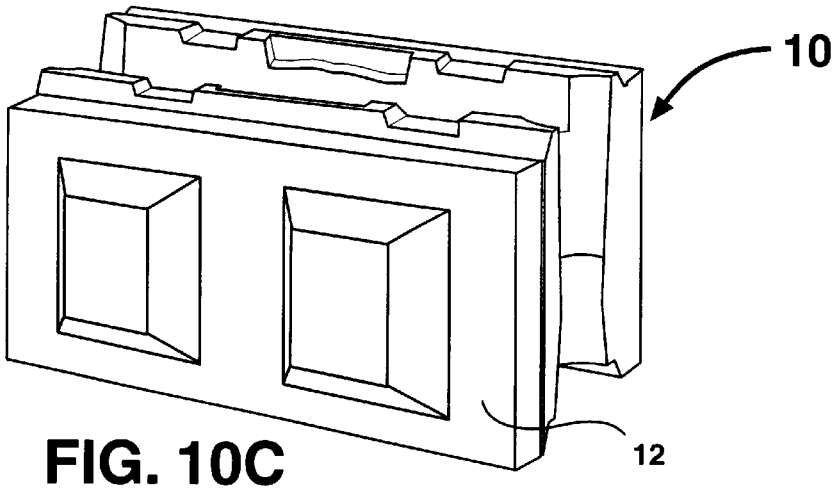
FIG. 10C is a perspective view of another embodiment of the present invention.

As shown in FIGS. 10A, 10B and 10C the side faces 12 (and 14) may comprise textures or decorations, for instance they might be formed to look like logs (FIG. 10A) for a mock log cabin construction, designs (FIG. 10B, FIG. 10C) or coated with different types of coatings (not shown).

Because the invention might be used for a wide variety of applications, not limited to retaining walls, building walls, columns, foundations, etc., assembly of the invented construction modules into such a structure is done through first establishing a level foundation having embedded vertically extended anchor bolts or other attachments means. A first course of modules would then be set upon this foundation with a bonding means applied between the foundation and the modules and between adjacent modules thereby forming a solid initial wall. Horizontal reinforcing bars could be laid into the horizontal sluice located in the top face of the modules. Anchor spanners and anchor nuts would then be attached to each of the anchor bolts and tightened down so that the anchor spanners fixedly contact the top faces of the modules, capturing the horizontal reinforcing bars, and fixedly holding the modules onto the footer. Reinforcing bar latches could be installed at appropriate locations to retain and secure the horizontal reinforcing bars as well. Bonding means could then be applied at the top of the first course of modules and a mixed course of modules could be applied to the first course, repeating the above procedures throughout the course of the modules in a staggered fashion.

While there is shown and described the present preferred embodiment of the invention, it is to be distinctly understood that this invention is not limited thereto, but may be variously embodied to practice within the scope of the following claims.

From the foregoing description, it will be apparent that various changes may be made without departing from the spirit and scope of the invention as defined by the following claims.

I claim:

1. A plurality of identical construction modules, wherein each module is in the general form of a generally right rectangular parallelepiped including:

a first side face and a second side face;

a first end face and a second end face;

a top face and a bottom face;

a center channel extending through the module from the top face to the bottom face;

adjacent top and bottom faces of plural modules able to be placed in a stacked relationship in a structure, interfitting in a positively locked relationship; whereby the top faces of the modules include at least one latitudinal groove extending perpendicular to the side faces and parallel to the end faces, whereby the bottom faces of the modules include at least one latitudinal tang extending perpendicular to the side faces and parallel to the end faces, said tang able to be received into the groove of the adjacent module, thereby interfittingly locking plural modules together; whereby said top face further comprising at least one longitudinal inner shoulder, and whereby said bottom face further comprising at least one longitudinal outer shoulder, said inner shoulder for receiving and interfitting with an outer shoulder of an adjacent module, thereby interfittingly locking plural modules together.

2. A construction module as in claim 1, wherein the stacked relationship of adjacent modules is staggered so that multiple modules may be interfitted together.

3. A construction module as in claim 1, wherein the number of grooves and tangs is each two and the number of inner shoulders and outer shoulders is each two.

4. A construction module as in claim 1, wherein adjacent top and bottom faces and first and second ends of plural modules are affixed together through use of a bonding means.

5. A construction module as in claim 4, wherein at least one of said top and bottom faces further comprises at least one relief for receiving a quantity of bonding means for assisting in the affixing of adjacent faces of plural modules together.

6. A construction module as in claim 4, wherein at least one of said end faces further comprises at least one relief for receiving a quantity of bonding means for assisting in the affixing of adjacent ends of plural modules together.

7. A construction module as in claim 1, wherein stacked modules have aligned center channels.

8. A construction module as in claim 7, wherein said center channel further comprises an attachment ledge at the top of said center channel for cooperation with an attachment means.

9. A construction module as in claim 8, wherein said attachment means is a reinforced bar.

10. A construction module as in claim 8, wherein said attachment means is an anchor spanner and anchor nut cooperating with an anchor bolt.

11. A construction module as in claim 7, wherein said ends further comprise vertical troughs, wherein said troughs of adjacent ends together jointly form end channels extending vertically, wherein stacked modules have aligned end channels.

12. A construction module as in claim 11, wherein when adjacent modules are oriented in a staggered formation, said end channels and said center channels align to form joint channels.

13. A construction module as in claim 1, wherein said sides further comprise at least one horizontal conduit.

14. A construction module as in claim 13, wherein an insert is placed into said horizontal conduit.

15. A construction module as in claim 1, wherein said sides further comprise at least one vertical conduit.

16. A construction module as in claim 12, wherein an insert is placed into said vertical conduit.

17. A construction module as in claim 1, wherein said sides further comprise at least one cavity along the length of a conduit extending within and along said side.

18. A construction module as in claim 1, wherein said module further comprises at least one joist relief notch extending generally downwards from the intersection of the top surface and one of the sides.

19. A construction module as in claim 1, wherein said top face comprises a longitudinal, horizontal relief sluice.

* * * * *